US008708257B2

(12) United States Patent
Gautschi et al.

(10) Patent No.: US 8,708,257 B2
(45) Date of Patent: Apr. 29, 2014

(54) SPRAY ATTACHMENT WITH A SEPARABLE HOLDING PART AND SPRAY HEAD

(75) Inventors: Christian Gautschi, Reinach (CH); Michael Lehner, Graenichen (CH)

(73) Assignee: KWC AG, Unterkulm (CH)

( * ) Notice: Subject to any disclaimer, the term of this patent is extended or adjusted under 35 U.S.C. 154(b) by 930 days.

(21) Appl. No.: 12/585,651

(22) Filed: Sep. 21, 2009

(65) Prior Publication Data

US 2010/0084492 A1 Apr. 8, 2010

(30) Foreign Application Priority Data

Oct. 4, 2008 (EP) ..... 08017447

(51) Int. Cl.
*B05B 1/00* (2006.01)

(52) U.S. Cl.
USPC ..... 239/600; 239/525; 239/74; 239/71

(58) Field of Classification Search
USPC ..... 239/600, 526, 71, 204, 525, 74, 587.1; 362/96
See application file for complete search history.

(56) References Cited

U.S. PATENT DOCUMENTS

| | | | | |
|---|---|---|---|---|
| 1,740,015 | A * | 12/1929 | Hooper et al. | 251/149.6 |
| 4,634,052 | A * | 1/1987 | Grizzle et al. | 239/205 |
| 5,213,267 | A | 5/1993 | Heimann et al. | |
| 5,344,080 | A | 9/1994 | Matsui | |
| 5,735,467 | A | 4/1998 | Lee | |
| 6,021,960 | A | 2/2000 | Kehat | |
| 6,116,750 | A | 9/2000 | Hentz | |
| 6,254,016 | B1 * | 7/2001 | Chao | 239/526 |
| 6,286,158 | B1 | 9/2001 | Lin | |
| 6,637,676 | B2 * | 10/2003 | Zieger et al. | 239/548 |
| 6,945,474 | B1 * | 9/2005 | Chen | 239/526 |
| 7,083,120 | B2 * | 8/2006 | Gilpatrick et al. | 239/397 |
| 7,191,476 | B1 | 3/2007 | Ko | |
| 7,284,981 | B2 | 10/2007 | Schmid et al. | |
| 2004/0188549 | A1 | 9/2004 | Habermacher et al. | |
| 2005/0116065 | A1 | 6/2005 | Yang | |
| 2006/0175437 | A1 | 8/2006 | Gross | |
| 2007/0220670 | A1 | 9/2007 | Woehrle et al. | |
| 2008/0245897 | A1 | 10/2008 | Nobili | |
| 2009/0236444 | A1 | 9/2009 | Kunkel et al. | |

FOREIGN PATENT DOCUMENTS

| | | | |
|---|---|---|---|
| DE | 29 09 298 | A1 | 9/1980 |
| DE | 91 09 457 | U1 | 11/1991 |
| DE | 41 18 540 | A1 | 12/1992 |
| DE | 93 17 167 | U1 | 1/1994 |
| DE | 201 01 460 | U1 | 8/2001 |
| DE | 103 07122 | A1 | 9/2004 |

(Continued)

OTHER PUBLICATIONS

U.S. Appl. No. 12/585,658, filed Sep. 21, 2009 by Christian Gautschi and Michael Lehner.

(Continued)

*Primary Examiner* — Dinh Q Nguyen
(74) *Attorney, Agent, or Firm* — Oliff PLC.

(57) ABSTRACT

The spray attachment has a holding part with a water guide that can be connected to a feed water pipe, and a spray head with an external housing. Said spray head and the holding part are fastened separably to each other by means of a coupling. Furthermore, the spray head can have switching options for producing different spray jets, and an illuminating means.

16 Claims, 11 Drawing Sheets

(56) References Cited

FOREIGN PATENT DOCUMENTS

| | | | |
|---|---|---|---|
| DE | 20 2004 016 297 | U1 | 6/2005 |
| DE | 10 2005 002 424 | A1 | 7/2006 |
| DE | 10 2005 002 426 | A1 | 7/2006 |
| DE | 20 2006 005 031 | U1 | 11/2006 |
| DE | 10 2006 020 766 | A1 | 11/2007 |
| DE | 10 2006 020 769 | A1 | 11/2007 |
| DE | 10 2006 021 701 | A1 | 11/2007 |
| DE | 20 2007 015 029 | U1 | 2/2008 |
| EP | 1 022 396 | A2 | 7/2000 |
| EP | 1 449 591 | A1 | 8/2004 |
| EP | 1462 051 | A | 9/2004 |
| EP | 1 464 889 | A2 | 10/2004 |
| EP | 1 531 204 | A1 | 5/2005 |
| EP | 1 829 581 | A1 | 9/2007 |
| GB | 2 288 974 | A | 11/1995 |
| JP | A-3-41918 | | 2/1991 |
| JP | A-4-73024 | | 3/1992 |
| JP | A-5-115813 | | 5/1993 |
| JP | A-8-93018 | | 4/1996 |
| JP | A-2006-83650 | | 3/2006 |
| JP | A-2006-320600 | | 11/2006 |
| JP | A-2007-258734 | | 10/2007 |
| KR | 1020020079505 | A | 10/2002 |
| KR | 1020030030723 | A | 4/2003 |
| KR | 100768965 | B1 | 10/2007 |
| WO | WO 2007/051367 | A1 | 5/2007 |
| WO | WO 2007/128448 | A1 | 11/2007 |
| WO | WO 2007/128500 | A1 | 11/2007 |
| WO | WO 2008/031431 | A1 | 3/2008 |

OTHER PUBLICATIONS

European Search Report issued in foreign Application No. EP 08 01 7447 issued Feb. 12, 2009.

European Search Report issued in foreign Application No. EP 08 01 7448 issued Jan. 13, 2009.

Gautschi et al., U.S. Appl. No. 12/585,658, filed Sep. 21, 2009.

Nov. 26, 2012 Office Action issued in U.S. Appl. No. 12/585,658.

* cited by examiner

SPRAY ATTACHMENT WITH A SEPARABLE HOLDING PART AND SPRAY HEAD

BACKGROUND

The exemplary embodiments of the present invention relate to a spray attachment, in particular, a kitchen spray.

A hand-held spray of this type is disclosed in document DE 103 07 122 A1. It has a spray head arranged on a holding part in a manner such that it can rotate about an axis. A tubular pin is arranged in a sealing manner in a bushing piece as a rotary joint for the water guide, and a bearing flange formed coaxially with respect to the tubular pin and the bushing piece is provided for the axial securing, the bearing flange resting on an axial bearing on one side and on an annular flange of a hollow screw arranged coaxially with respect to the axial bearing on the other side. The claw of a latching lever mounted on the holding part interacts with latching depressions in the spray head in order to fix the latter in the desired rotational position.

The spray head is connected rotatably, but non separably to the holding part. The holding part and the spray head could only be separated by removal of the entire spray head.

SUMMARY

In accordance with the exemplary embodiments, a spray has a holding part and spray head of which permits a greater range of use options.

For example, the spray head and the holding part are fastened to each other by a coupling. As a result of the use of a coupling, the holding part and spray head can be separated from each other without being destroyed; neither the holding part nor the spray head have to be removed for the separation.

Correspondingly designed holding parts and spray heads can therefore be combined as desired. In particular, it is possible to connect a spray head of one design to differently designed holding parts or to connect a holding part of one design to differently designed spray heads; the sole condition is that the coupling and therefore the corresponding connecting geometries of the holding part and of the spray head are matched to one another.

In a preferred manner, the coupling can be engaged and disengaged. The holding part and spray head can be separated only by changing over the coupling. When the coupling is not changed over, the connection is fixed.

BRIEF DESCRIPTION OF THE DRAWINGS

The present invention is explained in more detail with reference to exemplary embodiments illustrated in the drawings, in which, purely diagrammatically.

DETAILED DESCRIPTION OF EMBODIMENTS

Figure 1:
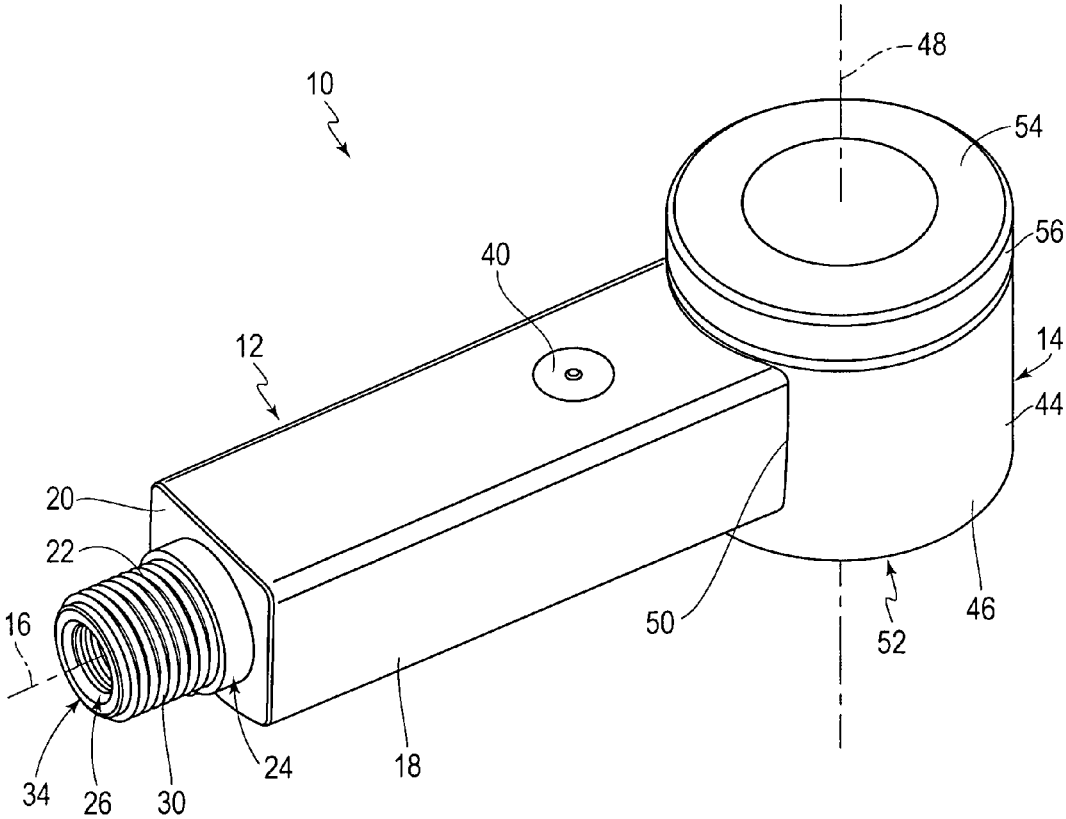
FIG. 1 shows, in a perspective illustration obliquely from above, a spray attachment according to an exemplary embodiment with a holding part and a spray head.
Figure 3:
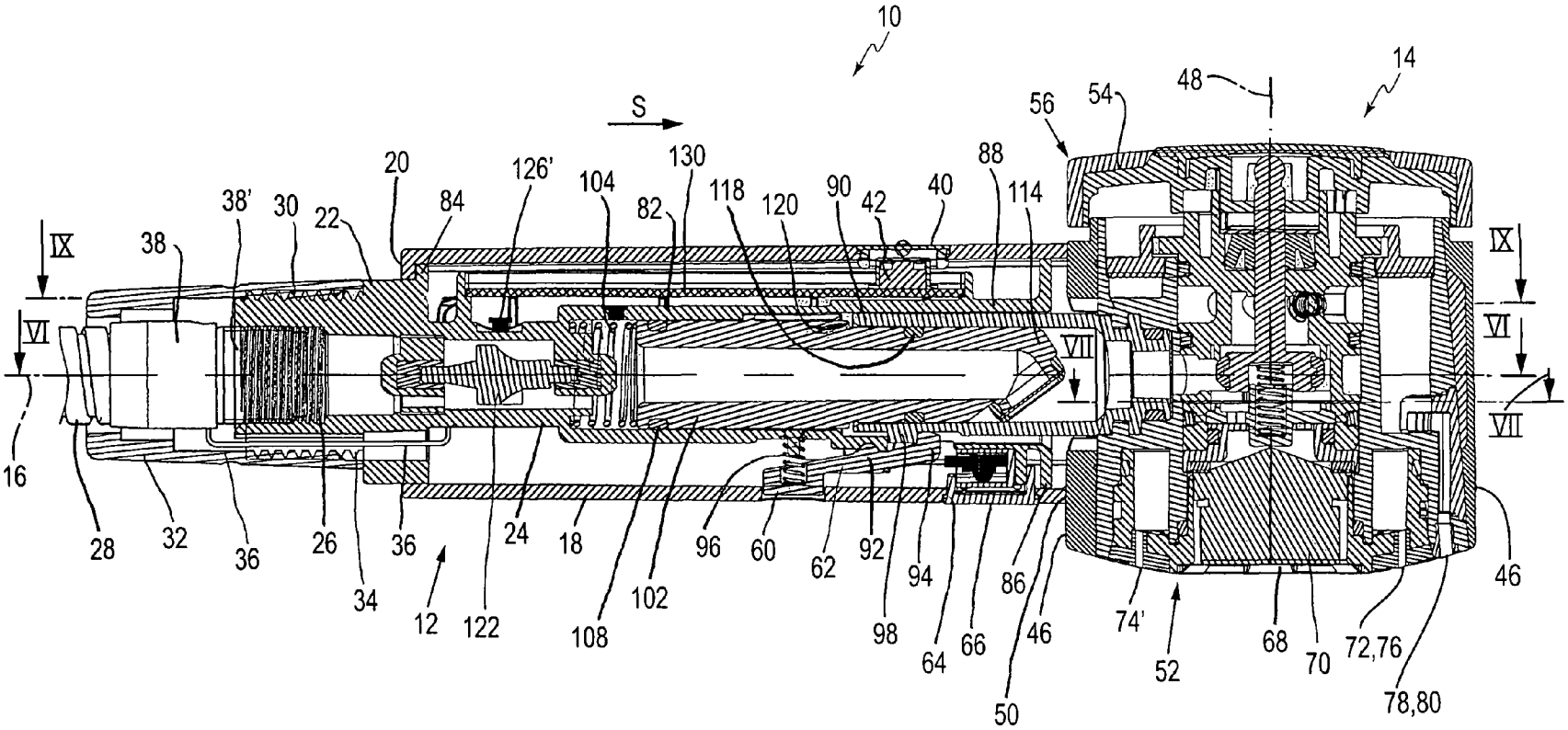
FIG. 3 shows, in a longitudinal section, the spray attachment shown in FIGS. 1 and 2 along the line III-III of FIG. 2.

The spray attachment 10 shown in FIG. 1, which is by way of example a kitchen spray, has a holding part 12 serving as a handle, and a spray head 14 arranged in a manner such that it can be taken away from the holding part. The holding part housing 18 extending in the direction of its longitudinal axis 16 preferably has a substantially rectangular cross section in which the edges running in the direction of the longitudinal axis 16 are rounded. A different, in particular circular cross section is also possible. A front side 20 of the holding part housing 18, which side is on the feed side, is passed through by a feed water connecting piece 22 of a water guide 24 which is otherwise arranged in the interior of the hollow holding part housing 18. The tubular feed water connecting piece 22 has an internal thread 26 for the connection of a feed water pipe 28 which, as revealed in FIG. 3, is formed in the present example by a flexible hose—as is generally known. Furthermore, the feed water connecting piece 22 is provided with an external thread 30 which serves for the fastening of a protective sleeve 32; FIG. 3. The feed water connecting piece 22 furthermore has a longitudinal groove 34, which is open to the outside in the radial direction, for an electric feed line 36, preferably in the form of a two-wire strand; compare FIG. 3. The electric feed line 36 runs from a power supply unit through the feed water pipe 28, between the outer metal casing thereof and inner water guiding hose, and emerges from the feed water pipe 28 at a connecting part 38 of the feed water pipe 28 to an external thread 38' interacting with the internal thread 26.

On the upper side of the holding part 12, the side facing away from the water outlet side 52 of the spray head 14, the holding part housing 18 is provided with a passage which is closed by a flexible membrane 40 in order to protect against the ingress of water into the interior of the holding part housing 18. The membrane and the passage serve to actuate a switch 42, which is described in more detail in conjunction with FIG. 3.

The spray head 14 has an outer housing 44 with an outer, preferably circular cylindrical casing wall 46. The resultant determined axis 48 of the spray head 14 runs at right angles to the longitudinal axis 16 of the holding part 12 and intersects the axis. The holding part housing 18 bears with its front side 50, which faces the spray head 14, against the casing wall 46 and is consequently shaped in the bearing section in a manner corresponding to the casing wall 46. Other cylinder shapes of the casing wall 46, for example with a square cross section, are also conceivable. It is also possible for the axis 48 and the longitudinal axis 16 to intersect at an acute or obtuse angle.

The spray head 14 furthermore has the water outlet side 52, which is located at the bottom in relation to the upper side of the holding part, which side is mentioned further above. Furthermore, the spray head 14 is provided on the upper side opposite the water outlet side 52 with a head-like actuating element 54. The latter is both rotatable about the axis 48 and also is movable in a translatory manner in the direction of the axis 48 from a starting position 56, as shown in FIG. 1, toward the outer housing 44 into a—pressed—lifting position 58 shown in FIGS. 10 and 11. The axis 48 is therefore the axis of rotation.

Figure 2:
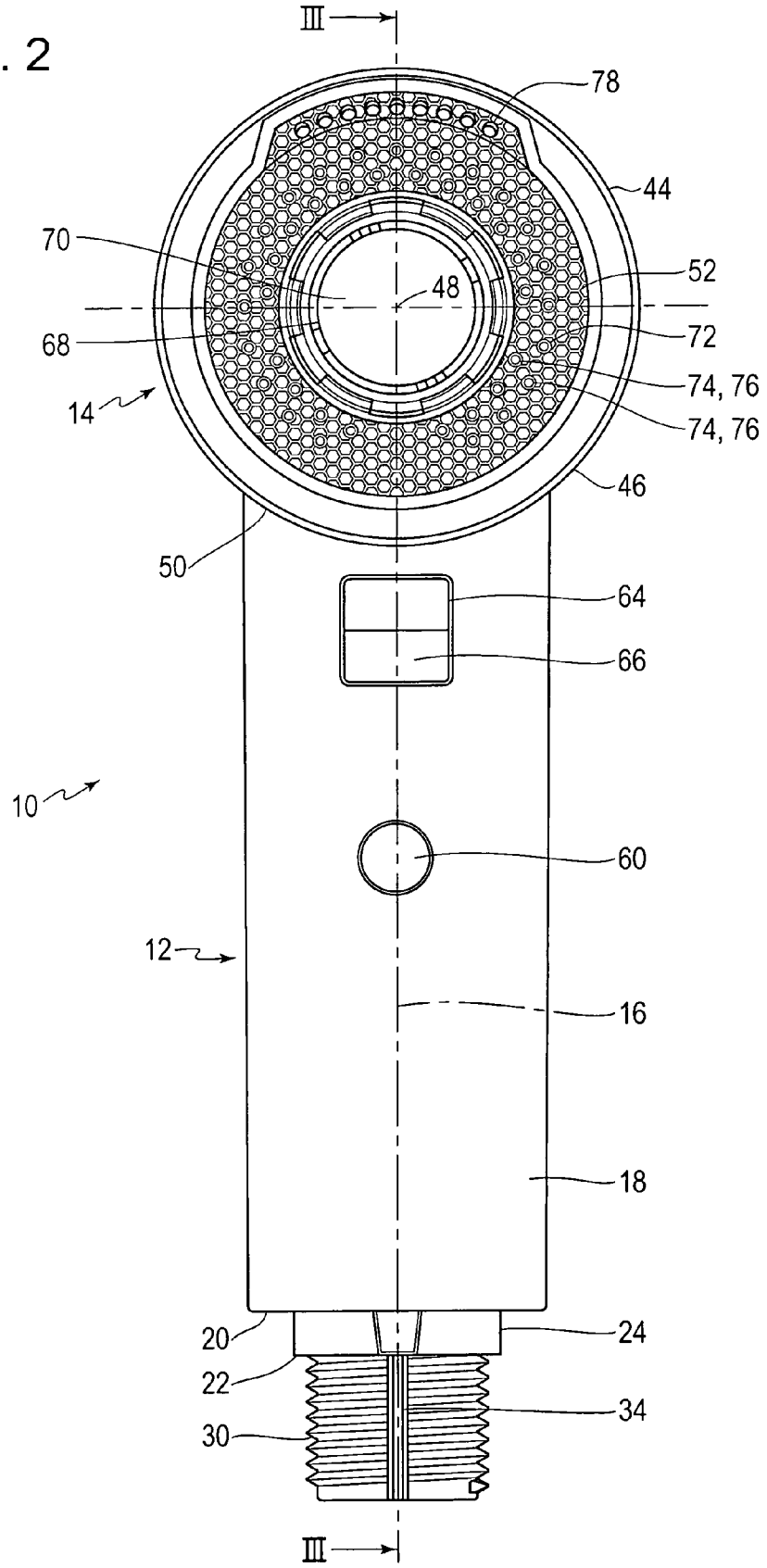
FIG. 2 shows the spray attachment according to FIG. 1 in a view from below.

FIG. 2 shows the spray attachment 10 in a view from below in which the same reference numbers as in FIG. 1 are used for the same parts. On the lower side, which lies on the same side as the water outlet side 52 of the spray head 14, the holding part housing 18 has, approximately in the longitudinal center, a passage in which an actuating head 60 of a latching lever 62 is arranged; compare FIG. 3. Furthermore, the holding part housing 18 has, likewise on the lower side, between the actuating head 60 and the front side 50, with which the holding part 12 bears against the casing wall 46, a light permeable opening 64 into which a transparent window element 66 is inserted. Furthermore, the longitudinal groove 34 for the electric feed line 36 in the region of the feed water-connecting piece 22 can readily be seen in FIG. 2.

In the center of its water outlet side 52, the spray head 14 has a first water outlet 68 with a generally known jet regulator 70. The latter produces a "gentle" spray jet.

A second water outlet 72 is formed by two rings 74, 74' of nozzle openings 76, the rings running with respect to the axis 48 and around the central, first water outlet 68. The nozzle openings serve to produce a spray jet in the form of a "strainer jet". Furthermore, the water outlet side 52 has a third water outlet 78 in the form of a row of further nozzle openings 80, the row being located on the side facing away from the holding part 12 and extending over an angular region of approximately 50° with respect to the axis 48. The row of further nozzle openings 80 arranged consecutively with little spacing serves to produce a spray jet in the form of a "smooth and even jet".

FIG. 3 shows the spray attachment 10 in longitudinal section with the holding part 12 and spray head 14 coupled to each other. The internal construction of the holding part 12 is described in conjunction with FIG. 4, and further on the internal construction of the spray head 14 is described in conjunction with FIG. 5 et seq.

In the interior of the holding part housing 18, the water guide 24 has, adjoining the feed water connecting piece 22, a central, tubular water guiding part 82 which is coaxial with respect to the longitudinal axis 16 and ends at a small distance from the front side 50 of the holding part housing 18, with respect to the length thereof. For the axial and radial support and fastening of the water guide 24 in the holding part housing 18, the feed water connecting piece 22 has a radially protruding stop rib 84 which bears, on the inner side of the holding part housing 18, against the front side 20 on the feed side. A supporting flange 86 protrudes from the water guiding part 82, at the end thereof which faces the front side 50, the supporting flange bearing circumferentially against the inner side of the holding part housing 18 and being connected to the latter, for example, by adhesive bonding or ultrasonic welding, in order at the same time to prevent dirt or water from penetrating the hollow space between the water guide 24 and the holding part housing 18.

An end region of the water guiding part 82, which end region faces the front side 50 and therefore the spray head 14, is designed as a joining region 88 for receiving a connecting piece 90 protruding in the radial direction from the outer housing 44 of the spray head 14. In the fitted state, the connecting piece 50 is joined to the water guide 24 in the direction of the longitudinal axis 16 by engaging in the joining region 88. In the vicinity of that end of the joining region 88 which is located upstream in the direction of flow S, the lower side of the water guiding part 82 has a pivot bearing 92 for the latching lever 62. The actuating head 60 is integrally formed at the end of one arm of the latching lever 62, and a latching claw 94 protruding radially inwards with respect to the longitudinal axis 16 is integrally formed at the end of the other arm. A compression spring 96 acts between the actuating head 60 and the water guiding part 82 in order to prestress the latching lever 62 into a latching position.

The lower side of the connecting piece 90 of the spray head 14 has a latching cheek 98 which is exposed to the outside in the radial direction and, in the fitted state, is engaged behind by the latching claw 94 in order to secure the spray head 14 on the holding part 12. In order to separate the spray head 14 from the holding part 12, the actuating head 60 therefore has to be pressed inward in the radial direction counter to the force of the compression spring 96, as a result of which the latching claw 94 releases the latching cheek 98 and the spray head 14 can be pulled away from the holding part 12 in the direction of the longitudinal axis 16. The latching cheek 98 engages in a groove-like expanded portion of the water guide 24 in the joining region 88, which expanded portion runs in the direction of the longitudinal axis 16, as a result of which the rotational position of the spray head 14 with respect to the holding part 12 is defined.

The joining region 88, the latching lever 62 and the connecting piece 90 with the latching cheek 98 form a coupling 100, for example, a switchable coupling, by means of which the holding part 12 and the spray head 14 are fastened releasably to each other. It should be mentioned at this juncture that different types of couplings can be used.

In the interior of the water guiding part 82 there is a hollow piston 102, on the upstream end of which a piston spring 104, which is designed as a compression spring, is supported, the other end of the piston spring being supported on an inner supporting shoulder 106 of the water guiding part 82. A sealing ring 108, which is designed as an O-ring and is arranged in a corresponding groove in the upstream end region of the hollow piston 102 acts between the water guiding part 82 and the hollow piston 102. The sealing ring prevents water from emerging between the water guiding part 82 and the hollow piston 102.

A guide cam 110 protrudes outward in the radial direction from the hollow piston 102 and engages in a guide groove 112 of the water guiding part 82, which guide groove is open in the radial direction toward the inside and runs in the direction of the longitudinal axis 16. As a result, the rotational position of the hollow piston 102 is defined, and the distance by which the hollow piston 102 can move in the direction of the longitudinal axis 16, is limited.

The downstream, free end region 114 of the hollow piston 102 is angled in the downward direction in order, when the spray head 114 has been removed, to direct any flowing feed water into the washbasin. For the sake of completeness, it should be mentioned that the hollow piston 102 has a filtering strainer 116 at the water outlet end. The filtering strainer forms a water outlet and prevents foreign bodies from penetrating the water guide 24 when the spray head 14 has been decoupled.

At a distance from its water outlet end, the hollow piston 102 has an encircling groove, which is open toward the outside in the radial direction and in which an O-ring 118 is arranged. Upstream of the O-ring 118, the hollow piston furthermore has an encircling stop shoulder 120. As can be gathered from FIG. 4, the hollow piston 102 protrudes under the action of the piston spring 104, and defined by the guide cam 102 bearing against the downstream end of the guide groove 112, over the front side 50 of the holding part housing 18 when the spray head 14 is removed from the holding part 12. This enables water to be drawn off even when the spray head 14 has been removed. When the connecting piece 90 of the spray head 14 is introduced into the water guiding part 82, the connecting piece 90 surrounds the hollow piston 102 and, by striking with its free end against the stop shoulder 120, pushes the hollow piston, counter to the force of the piston spring 104, into the joining region 88 of the water guiding part 82 and therefore into the holding part housing 18, as FIG. 3 shows. During the movement, by the action of the latching cheek 98 against an oblique surface of the latching claw 94, the latching lever 62 is pivoted counter to the force of the compression spring 96 until it can automatically pivot back into the latching position when the connecting piece 90 is fully inserted and the latching lever has therefore been released by the latching cheek 98. When the connecting piece 90 is inserted, the O-ring 118 comes to bear against the inner wall thereof in order to prevent water from emerging between the hollow piston 102 and the connecting piece 90.

As seen in the direction of the longitudinal axis 16, a small turbine wheel 122 is mounted between the feed water connecting piece 22 and the supporting shoulder 106 in a manner such that it can rotate freely about the longitudinal axis 16. For the mounting of the small turbine wheel, the water guiding part 82 has a radially inwardly protruding bearing rib 124, and a cylindrical bearing body 125 having axial water passages is inserted and snap-fastened into the water guide 24, from the side of the feed water connecting piece 22.

When feed water is flowing, the small turbine wheel 122 rotates, which is detected by means of a sensor 126. The sensor is arranged in a radially outwardly open depression in the water guiding part 82, for example is fastened therein by means of casting or adhesive bonding, and, together with this small turbine wheel 122, forms a flow sensor 126', the signal of which is supplied to an electronic control circuit 128. The latter is located on a printed circuit board 130, which is accommodated by an encircling collar 132 protruding upward from the water guiding part 82. The collar is shaped in a manner corresponding to the rectangular printed circuit board 130, as can be gathered from FIG. 9. Furthermore, the switch 42 is arranged on the printed circuit board 130. In a preferred manner, the space surrounded by the collar 132 is filled by means of a casting compound in order to protect the electronic control circuit 128 against water and other environmental influences. In order not to put the functioning capability of the switch 42 at risk as a result, the switch is preferably covered by a hat-shaped, elastic covering 134.

Furthermore, a temperature sensor 136 for detecting the temperature of the feed water is inserted into the water guiding part 82, as seen in the direction of the longitudinal axis 16, between the supporting shoulder 106 and the hollow piston 102. The temperature sensor also emits its output signal to the electronic control circuit 128.

Figure 4:
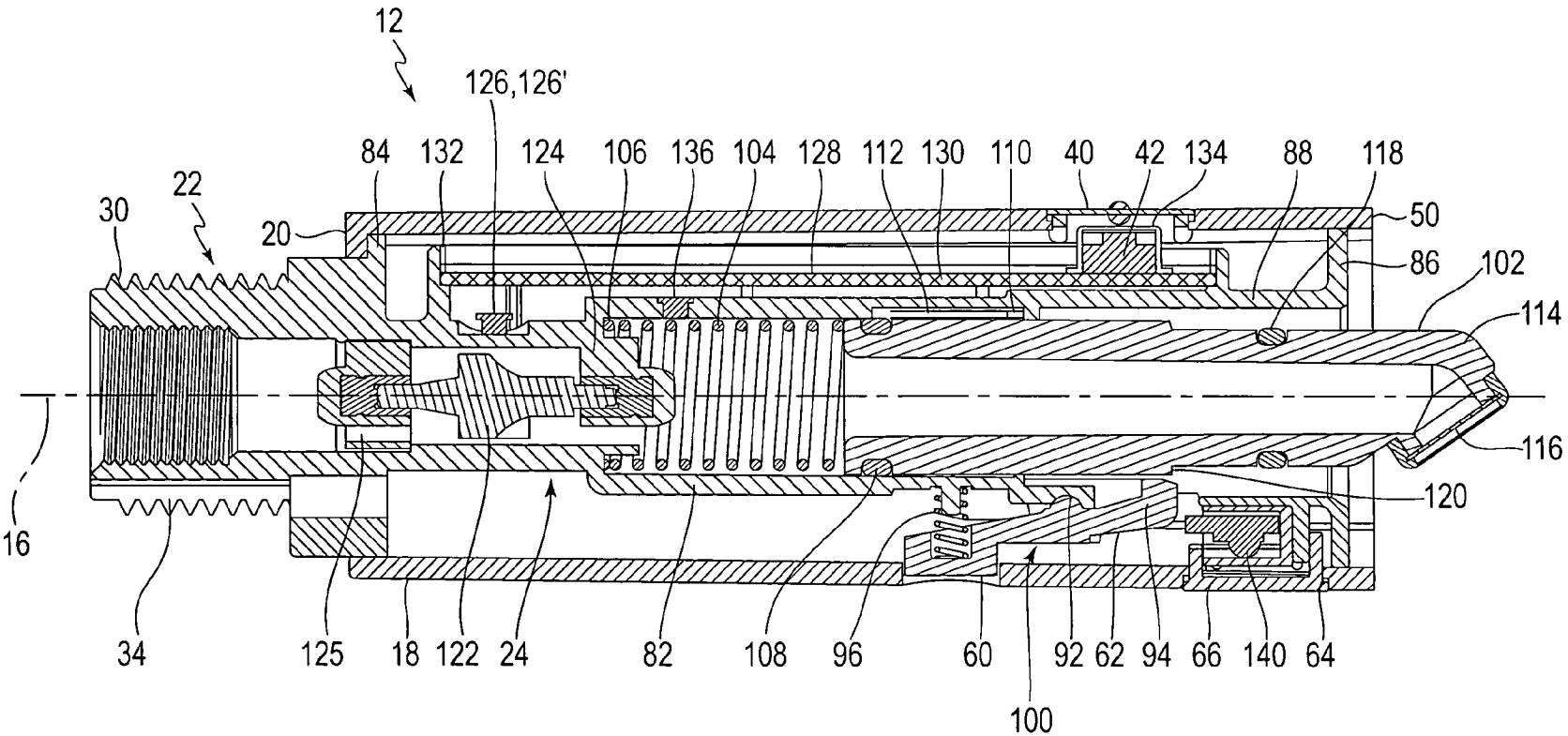
FIG. 4 shows, in an identical illustration to FIG. 3, the holding part with an automatically extended hollow piston when the spray head is separated from the holding part.
Figure 6:
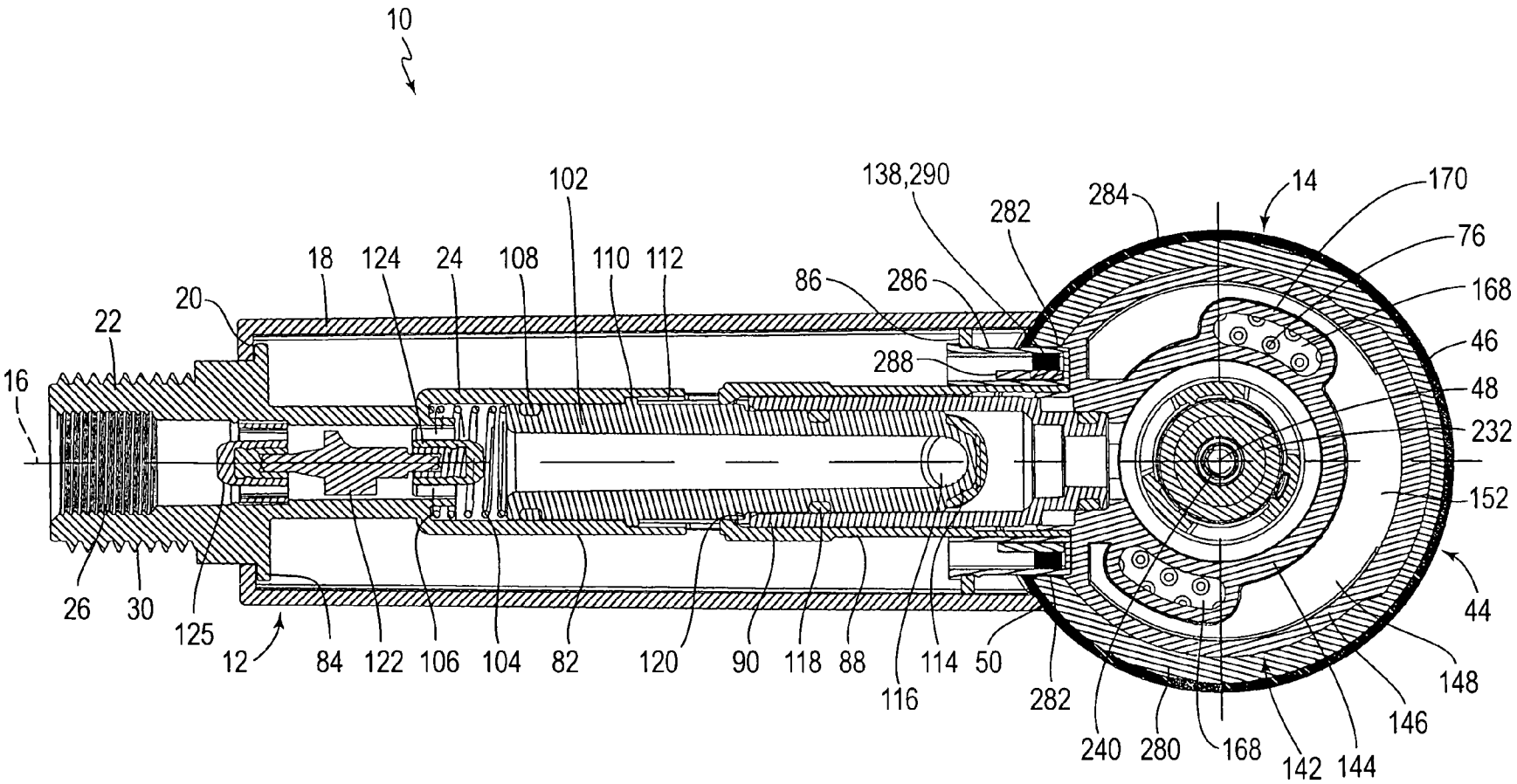
FIG. 6 shows the spray attachment shown in FIGS. 1 to 3 in a longitudinal section along the line VI-VI of FIG. 3.

The electronic control circuit 128 feeds a light source 138, see FIG. 6, for illuminating the spray head 14 and also feeds a further light source 140 in the light permeable opening 64 for illuminating the surroundings, in particular in the region of action of the spray jets, FIG. 4. It should be mentioned for the sake of completeness that the electronic feed line 36, coming from the longitudinal groove 34, is guided in the cavity between the holding part housing 18 and the water guide 24 in order to feed the electronic control circuit 128 to the printed circuit board 130.

An outer housing 44 in conjunction with the spray head 14 is to be understood as meaning a housing which delimits the spray head 14 from the surroundings and is therefore not arranged in the interior of another housing, for example of the holding part 12.

The spray head 14 has a supporting body 142, including a hollow-cylindrical inner wall 144, which is coaxial with respect to the axis 48, and a likewise hollow-cylindrical outer wall 146 which is concentric with respect to the inner wall, an intermediate base 148 which connects the inner wall 144 to the outer wall 146 dividing the space between the inner wall 144 and the outer wall 146 into a lower first chamber 150 facing the water outlet side 52 and into an upper second chamber 152 facing the actuating element 54, also see FIGS. 5 to 11. On the side of the connecting piece 90, the intermediate base 148 forms an outwardly open receiving sleeve 154 which is coaxial with respect to the longitudinal axis 16 with mutually opposite undercuts 156, as seen in the direction of the axis 48. The tubular connecting piece 90 is inserted at its end region on this side into the receiving sleeve 154, the connecting piece engaging behind the undercuts by means of two diametrically opposite and outwardly protruding snap-in lugs 158 and therefore being fastened to the supporting body 142 in a defined rotational position. Adjoining the snap-in lugs 158 downstream in the flow direction S, the connecting piece 90 has a receiving groove with an O-ring 160 arranged therein in order to prevent water from emerging between the supporting body 142 and the connecting piece 90. The latching cheek 98 of the connecting piece 90 protrudes downward, i.e. in the direction of the water outlet side 52.

An inflow passage 162 is integrally formed on the inner wall 144 centrally with respect to the receiving sleeve 154, which is formed by the intermediate base 148.

Figure 7:
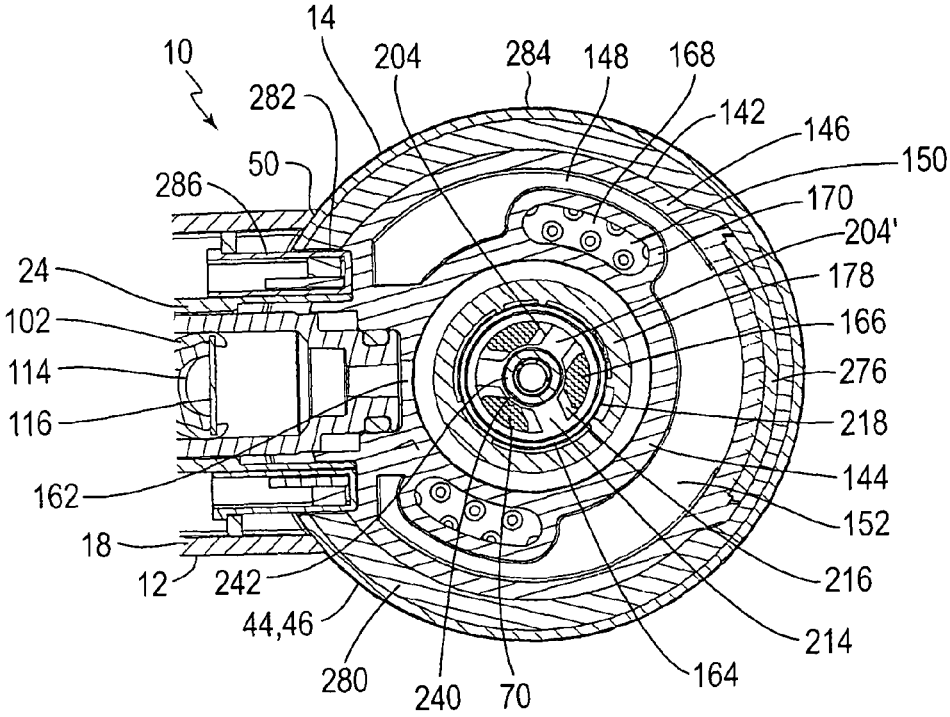
FIG. 7 shows the spray head and a part of the holding part in a section along the line VII of FIG. 3 at a maximum water flow rate.
Figure 8:
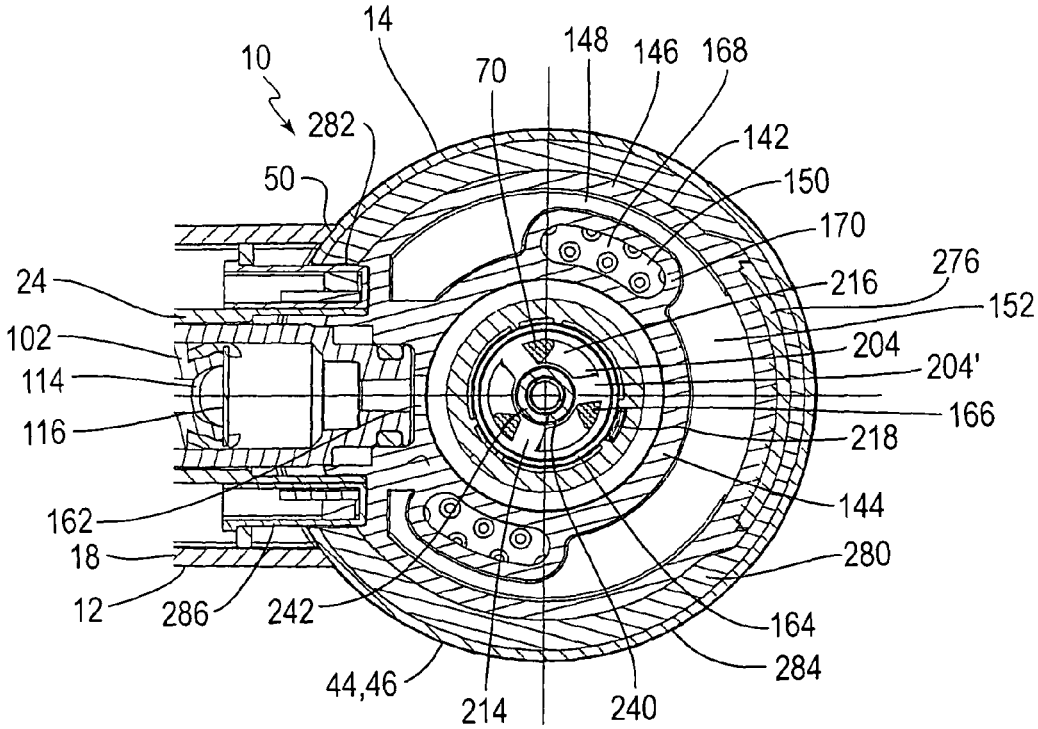
FIG. 8 shows the spray attachment in an identical illustration as in FIG. 7 at a reduced water flow rate.

An outflow element 164 which is shaped in the manner of a disk and the three passages of which, which are distributed in the circumferential direction, form a housing-mounted first outflow passage 166 is inserted in a rotationally fixed manner into the space bounded circumferentially by the inner wall 144, see FIGS. 7 and 8. As seen in the direction of the axis 48, the outflow element 164 is arranged with respect to the inflow passage 162 on the side facing the water outlet side 52.

The intermediate base 148 has two continuous openings offset by, for example, 60° with respect to the longitudinal axis 16 in order to connect two diametrically opposite inflow channels 168 to the first chamber 150; see in particular FIGS. 6 to 10. The inflow channels 168 are separated from the second chamber 152 by means of pocket-like walls 170 integrally formed on the radially outer side of the inner wall 144. At the upper end of the inflow channels 168 that is remote from the water outlet side 52, two passages that are arranged next to each other in the circumferential direction and form a second outflow passage 172 in each case run through the inner wall 144; see in particular FIG. 9. Offset with respect to the passages, for example by an angle of 45°, and outside the walls 170, as seen in the circumferential direction, the inner wall 144 has further passages, again lying diametrically opposite and next to one another in pairs in the circumferential direction, the passages forming a third outflow passage 174 and leading into the second chamber 152. The second and the third outflow passages 172, 174 are located at the same height, as seen in the direction of the axis 48, and at a distance with respect to the inflow passage 162, on the side facing away from the water outlet side 52 and facing the actuating element 54.

Figure 5:
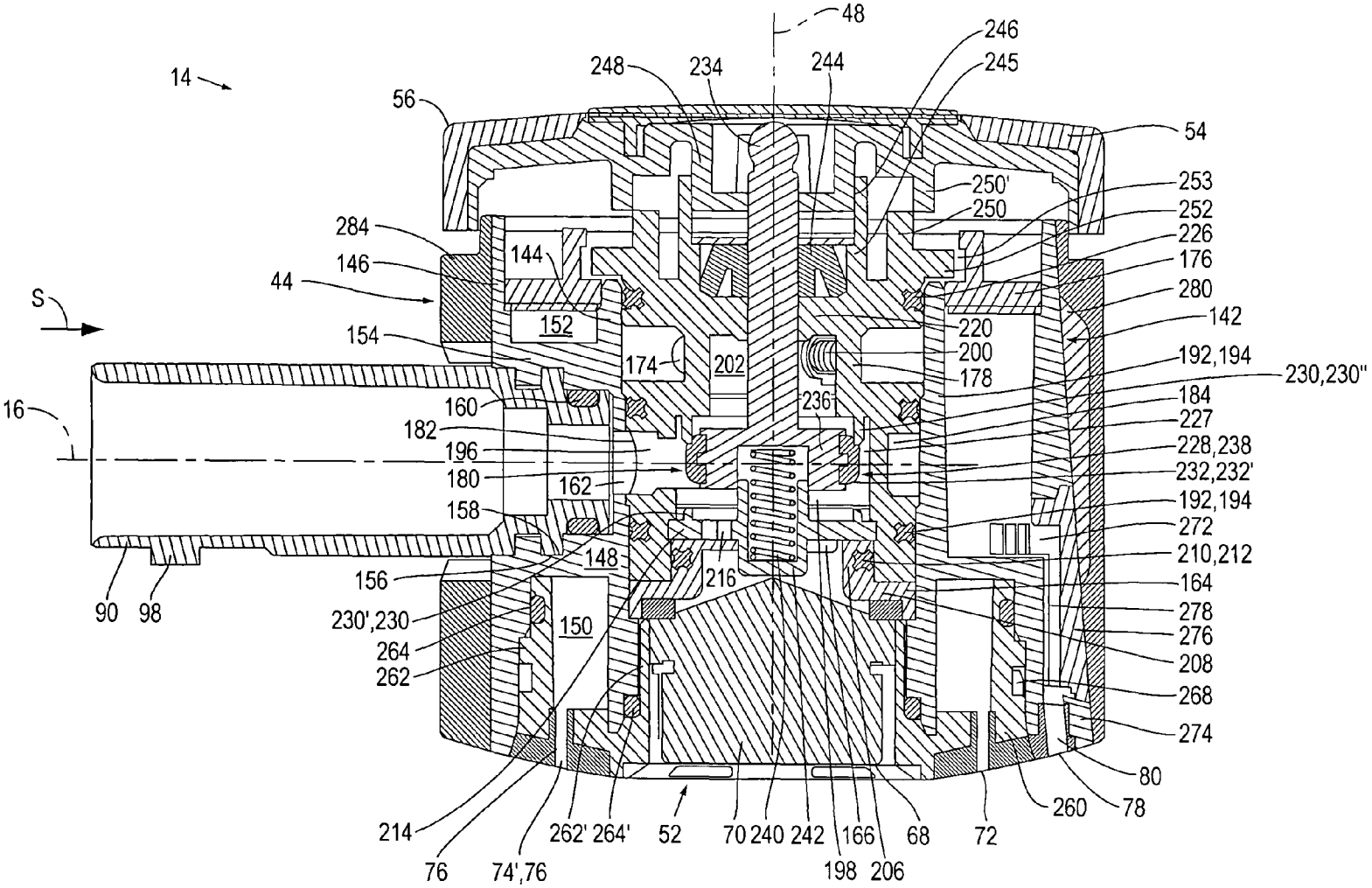
FIG. 5 shows the spray head in the same section as in FIGS. 3 and 4.

The second chamber 152 is closed by an annular disk-shaped cover 176 on the side facing the actuating element 54, FIG. 5. At the upper end of the inner wall 144, the cover runs between the latter and the outer wall 146 and is fastened in a watertight manner in a defined rotational position, for example by being adhesively bonded to the two walls 144, 146. The defined rotational position can be predetermined, for example, by a groove on the supporting body 142 and a protruding lug of the cover 176, the lug engaging in the groove.

Furthermore, a substantially cylindrical control element 178 is inserted into the space bounded circumferentially by the inner wall 144, the control element being located with respect to the outflow element 164, in the direction of the axis 48, on the side facing the inflow passage 162. It is provided with a connecting channel 180, the inlet opening 182 of which is permanently connected to the inflow passage 162. For this purpose, the control element 178 has an encircling flow groove 184 which is open outward in the radial direction, communicates with the inflow passage 162 irrespective of the rotational position of the control element 178 and on the groove base of which the inlet opening 182 is located. As seen in the direction of the axis 48, the control element 178 has a respective encircling sealing groove 192 on either side of the flow groove 184, into each of which a quad ring 194, which interacts at the other end with the inner wall 144, is inserted in order to prevent water from leaking.

The connecting channel 180 has an inflow section 196 that runs in the radial direction with respect to the axis 48 and has the inlet opening 182. Branching off from the inflow section, coaxially with respect to the axis 48, in the direction of the water outlet side 52 is a first outflow section 198 leading to the first outflow passage 166 and, in the opposite direction, a second outflow section 202 leading to a control passage 200.

The passages forming the first outflow passage 166, for example three passages which are distributed in the circumferential direction and are separated by webs 204 running in the radial direction, also see FIGS. 7 and 8, are formed on a disk-shaped section of the outflow element 164, which section is adjoined radially outward, in the direction of the water outlet side 52, by a section 206 coaxial with respect to the axis 48 and the latter is then adjoined by a radial flange section 208. On its radially outer side, the coaxial section 206 has an encircling groove 210 in which a further quad ring 212 is arranged, the quad ring interacting radially on the outside with the control element 178 which engages in the annular space delimited by the flow element 164 and the inner wall 144 and bears with its end side on this side in a sliding manner against the flange section 208 and on the other side mounted on the housing keeps the flange section in contact with a shoulder of the inner wall 144.

A control disk 214, on which continuous openings, which are distributed in the circumferential direction and form a further control passage 216 are formed, bears in a planar manner against the disk-like section of the outflow element 164. The number of the openings coincides with the number of openings forming the first outflow passage 166, and the openings are separated from one another by further webs 204'. The latter are preferably of narrower design than the webs 204. Three carry-along cams 218 which are distributed in the circumferential direction protrude radially on the outside from the control disk 214, in the upward direction on the side facing away from the outflow element 164—FIGS. 7 and 8—the carry-along cams engaging in a manner rotationally fixed in terms of being carried along in corresponding carry-along grooves of the control element 178, the carry-along grooves running in the axial direction. The control disk 214 is held in the axial position by the outflow element 164 and by a shoulder formed on the control element 178, see in particular FIG. 5 in this respect. The control disk 214 is therefore arranged at the downstream end of the first outflow section 198.

At its end located downstream and facing the actuating element 54, the second outflow section 202 is bounded by a transverse wall 220 of the control element 178, with in each case two passages which form the control passage 200 being formed diametrically opposite with respect to the axis 48 by that wall section of the control element 178 which circumferentially bounds the second outflow section 202. As seen in the direction of the axis 48, the passages are arranged at the same height as the second and third outflow passages 172, 174 and are placed next to each other, as seen in the circumferential direction, in such a manner that, in one rotational position of the control element 178, the are aligned with the openings of the second outflow passage 172 and, in the other rotational position of the control element 178, are aligned with those of the third outflow passage 174, FIG. 9. A sealing sleeve 222 is inserted in each of the passages of the control passage 200 in a manner such that it provides a seal circumferentially but is displaceable in the radial direction. In the interior of each sealing sleeve 222 there is a compression spring 224 which is supported radially on the inside on the control element 178 and radially on the outside on a shoulder of the sealing sleeve 222 in order to hold the sealing sleeve in slideable, but sealing contact with the inner wall 144 of the supporting body 142.

The transverse wall 220 is provided on the radially outer side thereof with an encircling groove into which a third quad ring 226 is inserted, the quad ring interacting radially on the outside with the inner wall 144, in the vicinity of the upper end thereof. The third quad ring 226 prevents any leakage water from emerging between the supporting body 142 and the control element 178 in the direction toward the actuating element 54 and preventing dirt particles from penetrating between the inner wall 144 and the control element 178.

In the region of the junction 227 of the connecting channel 180 from the inflow section 196 into the first and second outflow sections 198, 202, the control element 178 has a valve arrangement 228. The latter has two valve seats 230 arranged at a distance from each other in the direction of the axis 48, and a valve member 232 arranged between the valve seats. The valve seat 230 assigned to the first outflow section 198 is designed as an annular seat 230' which is integrally formed on the control disk 214 and runs on the outside in the radial direction around the openings forming the control passage 216. The valve seat 230 assigned to the second outflow section 202 is designed as a further annular seat 230" which is opposite the annular seat 230' and is integrally formed directly on the control element 178. The valve member 232 arranged between the two annular seats 230' and 230" is designed as a valve disk 232'. The latter has a disk section 236 which is integrally formed on an actuating stem 234, which is central with respect to the axis 48, and with an annular seal 238 sitting radially on the outside of the disk section, the annular seal interacting in a sealing manner either with the annular seat 230' or with the annular seat 230", depending on the lifting position of the actuating stem 234.

On its side facing the control disk 214, the disk section 236 has a central recess which is in the manner of a blind hole and in which a resetting spring 240 designed as a compression spring is supported. The resetting spring engages in a central cup part 242 of the control disk 214 and is supported on this side on the base of the cup part 242. The cup part 242 engages with its open end region in the recess of the disk section 236 and reaches with its bottom-side end section through a central opening in the outflow element 164. The first outflow passage 166 and the further control passage 216 are arranged on the outside in the radial direction with respect to the cup part 242.

The actuating stem 234 reaches through the transverse wall 220 of the control element 178 and, at its free end facing away from the disk section 236, bears the actuating element 54. In order to prevent water from emerging from the second outflow section 202 along the actuating stem 234 to the surroundings, the actuating stem is engaged around by an annular lip seal 244, which is V-shaped in cross section, the radially inner lip interacting with the actuating stem 234 and the radially outer lip interacting with the transverse wall 220. The lip seal 244 is arranged in a hollow-cylindrical stub 245 of the transverse wall 220, the stub protruding in the direction toward the actuating element 54, and is held there by means of a snap ring. Centering tongues 246 protrude from the stub 245 parallel to the axis 48 in the direction of the actuating member 54 and bear circumferentially against a central centering stub 248 of the actuating member 54.

Radially on the outside with respect to the stub 245, the transverse wall 220 has a carry-along ring 250 that protrudes in the direction of the actuating element 54 and, on diametrically opposite sides at the free end thereof, a respective carry-along cam protrudes outward in the radial direction. The carry-along cams engage in corresponding recesses on a carry-along ring 250' of the actuating element 54 in order to form a rotationally fixed connection between the actuating element 54 and the control element 178 and in order to secure the actuating element 54 in the axial direction, with the lifting movement of the actuating element 54 relative to the control element 178 remaining ensured.

Stop projections 252 protrude diametrically opposite each other and in the radial direction toward the outside from the carry-along ring 250, the stop projections engaging in guide grooves 253 which are integrally formed on the cover 176, form counter stops, which act in the circumferential direction, for the stop projections 252 and keep the control element 178 positioned in a manner fixed in terms of displacement in the direction of the axis 48. It should be mentioned for the sake of completeness that the guide grooves 253 permit a rotational movement of the control element 278 between the rotational positions corresponding to the second and third outflow passages 172, 174, but prevent further rotation therebeyond.

With its section located downstream with respect to the first outflow passage 166, the inner wall 144 surrounds the central first water outlet 68, which is connected in terms of flow to the first outflow passage 166 without any obstacles and is preferably equipped with the jet regulator 70. Jet regulators of this type are known in general, are sold, for example, by Neoperl under the trade name "Perlator" and have the task of mixing air with the water and thus of ensuring a uniform, gentle, expanded spray jet.

On the water outlet side 52, an annular water outlet cover 260 is placed onto the supporting body 142, the water outlet cover leaving the central first water outlet 68 free, but closing the first chamber 150. The two rings 74, 74' of nozzle openings 76 of the second water outlet 72 are formed on the water outlet cover. In a preferred manner, the passages forming the nozzle openings and an exposed region around the passages are lined with a flexible material, for example rubber, in order in particular to counteract calcification.

Radially on the outside with respect to the nozzle openings 76, the water outlet cover 260 has a cylinder wall 262 which protrudes in the direction toward the interior of the first chamber 150 and has, radially, on the outside in the vicinity of the free end, a groove which is provided with an O-ring 264 in order to avoid the leakage of water out of the first chamber 150 between the water outlet cover 260 and the outer wall 146. Furthermore, the cylinder wall 262 has, between the O-ring 264 and the water outlet side 52, a further circumferential groove which is open to the outside in the radial direction and with which snap-in lugs 268 formed on the outer wall 146 enter into engagement when the water outlet cover 260 is installed by the cylinder wall 262 being introduced into the first chamber 150, in order to fasten the water outlet cover 260. Radially on the inside, the water outlet cover 260 has a further cylinder wall 262' which engages in the space forming the first water outlet 68 and to which the jet regulator 70 is fastened by means of a threaded connection. Furthermore, a sealing ring 264' interacts with the further cylinder wall 262', the sealing ring being arranged in a corresponding sealing groove of the inner wall 144 and preventing water from passing from the first water outlet 68 into the first chamber 150 and vice versa.

On the side facing away from the connecting piece 90, the outer wall 146 has a recess 272 which is connected above the intermediate base 148 to the second chamber 152 and extends in the direction toward the water outlet side 52 as far as a bead 274 of the outer wall 146, the bead protruding outward in the radial direction. The further nozzle openings 80 forming the third water outlet 78 are formed on the bead, the nozzle openings also preferably being encased by a rubber-like material. The recess 272 is closed by a cover element 276 in such a manner that the latter bounds a flow gap 278 between itself and the outer wall 146, the flow gap leading from the second chamber 152 to the third water outlet 78.

A fiber optic element 280 is arranged on the radially outer side of the outer wall 146 of the supporting body 142, the fiber optic element, as seen in the direction of the axis 48, running approximately over half the height of the outer wall 146 and approximately symmetrically with respect to the connecting piece 90 and around the supporting body 142 in the circumferential direction to a point at a distance from the connecting piece 90, with those end sides 282 of the fiber optic element 280 which face each other and are opposite each other with respect to the longitudinal central plane of the spray attachment 10 forming light coupling-in surfaces; see FIG. 6. From the one end side 282 around the supporting body 142 to the opposite end side 182, the fiber optic element 280 is covered by a flexible, preferably rubber-like, opaque outer casing 284 which, as seen in the direction of the axis 48, also completely covers the supporting body 142 above and below the fiber optic element 280. The outer casing 284 forms the outer surface of the outer housing 44 of the spray head 14. When the spray head 14 is coupled to the holding part 12, the front side 50 of the holding part housing 18 bears with its entire circumference against the outer casing 284. In this case—as a result of its rubber-elastic properties—the outer casing 284 forms a seal.

As can be gathered from FIGS. 6 to 9, the supporting flange 86 has, as seen in top view, a respective passage hole on either side of the water guide 24, into which passage hole a respective cup-like, dimensionally stable sleeve 286 made of light-permeable material is inserted, with the open front side pointing in the direction toward the interior of the holding part housing 18 and the closed end side pointing in the direction toward the spray head 14. In a preferred manner, the cross section of the passage hole is of rectangular design and the outer cross section of the sleeve 286 is of corresponding rectangular design. A small printed circuit board 288 with an LED 290 arranged thereon and forming the light source 138 is located in each of the sleeves 286. The direction of the beam of the two LEDs 290 is directed away from each other such that—when the spray head 14 is coupled to the holding part 12—the light emitted via the end sides 282 is coupled into the fiber optic element 280. When the LEDs 290 are activated, the fiber optic element 280 is therefore illuminated, which can be readily seen from the outside through the opaque outer casing 284. It should be mentioned for the sake of completeness that the LEDs 290 are activated by the electronic control circuit 128.

In the starting position 56, as shown in FIGS. 3 and 5, the valve member 232 bears as a result of the force of the resetting spring 240 against the upper valve seat 230 which is assigned to the second outflow section 202. As a result, the connecting piece 90 is connected in terms of flow via the inflow passage 162 and the first outflow section 198 to the first outflow passage 166. At the same time, the control passage 200 and therefore the second and third outflow passages 172, 174 are separated in terms of flow from the inflow passage 162. Feed water supplied through the feed water pipe 28 flows through the water guide 24, the hollow piston 102 and the connecting piece 90 to the first water outlet 68 where a gentle spray jet is produced by means of the jet regulator 70. If the actuating member 54 is in a first rotational position here, as can be seen in FIG. 8, the passages of the first outflow passage 166 only partially overlap by the passages of the further control passage 216 of the control disk 214. The webs 204' thereof partially cover the first outflow passage 166. The water flow rate is reduced in this position, for example is restricted to 6 liters per minute, at a customary feed water pressure of 3 bar.

If, starting from the first rotational position, the actuating element 54 is rotated, as seen in top view, counterclockwise into the second rotational position, see FIG. 7, the control passage 216 of the control disk 214 fully overlaps the second outflow passage 166 such that the further webs 204' of the control disk 214 are aligned with the webs 204, as a result of which the maximum flow cross section is free and there is a water flow rate of, for example, twelve liters per minute. Therefore, in the starting position 56, by rotation of the actuating element 54 the quantity of water can be selected without the control cartridge, which releases the feed water and controls the temperature thereof having to be actuated for this purpose.

For the sake of completeness, it should be mentioned that the difference between the pressure of the water in the spray head 14 and the surroundings is applied via the valve member 232 and therefore the valve member 232, assisted by the pressure, is pressed with greater force against the relevant valve seat 230.

Figure 10:
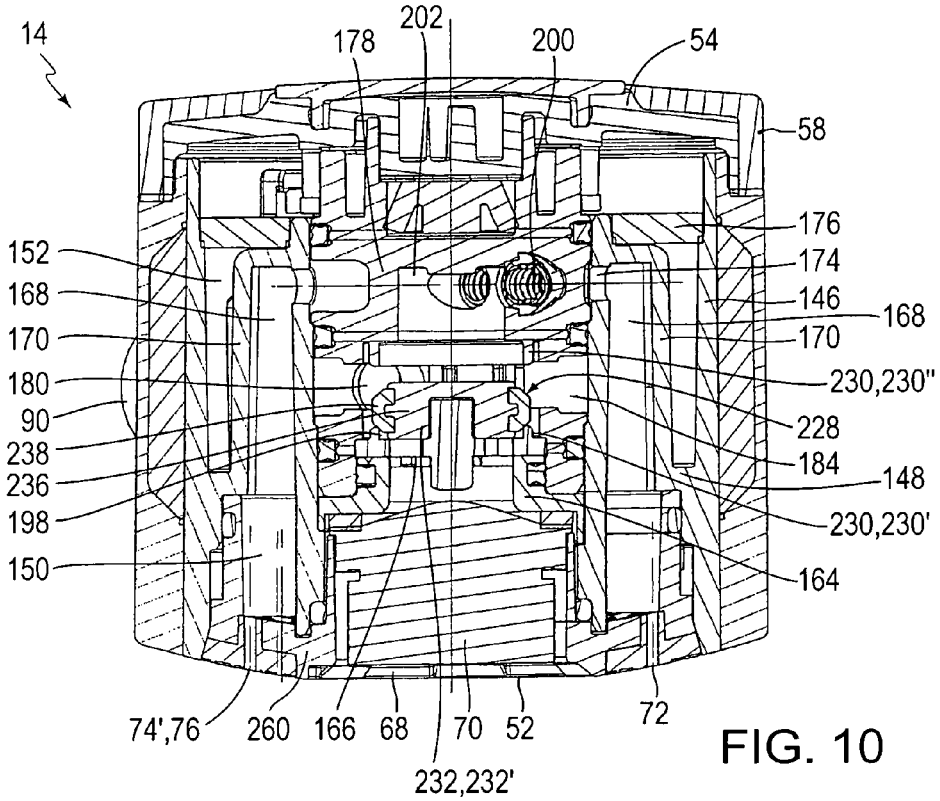
FIG. 10 shows, in a section along the line X-X of FIG. 9, the spray head in the position for producing a strainer jet.
Figure 11:
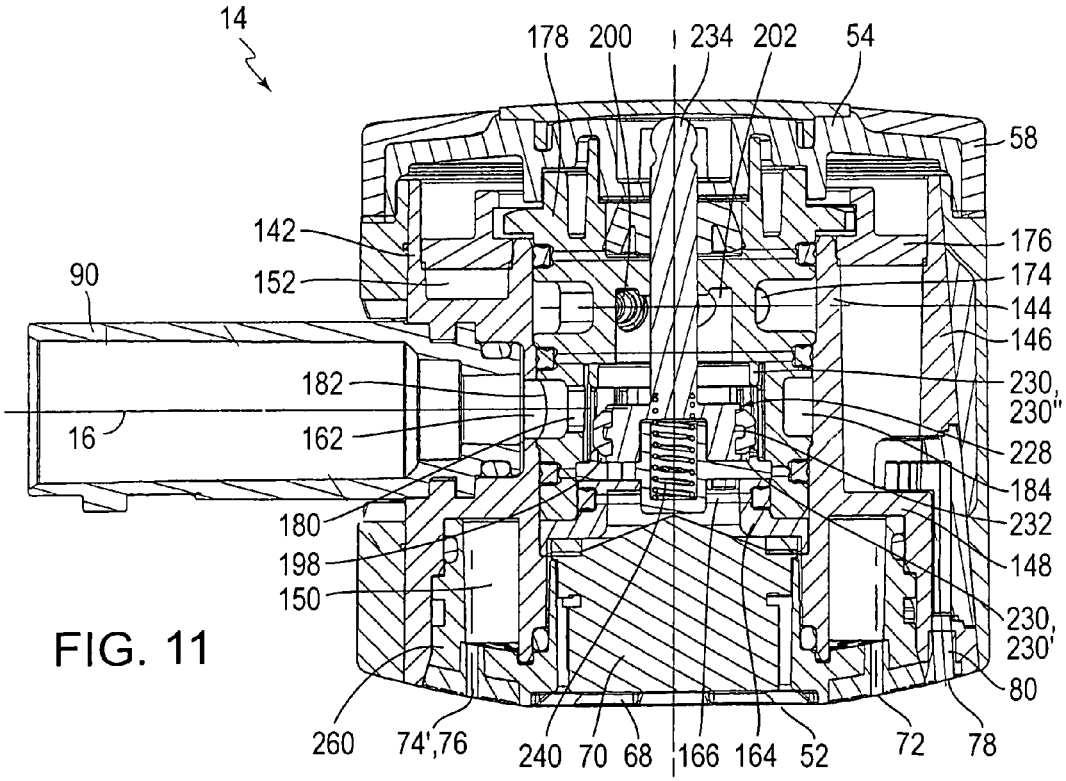
FIG. 11 shows the spray head in the longitudinal section along the line XI-XI of FIG. 9 in the position for producing a smooth and even jet.

If no feed water is flowing, and the actuating element 54, starting from the starting position 56 shown in FIGS. 3 and 5, is moved downward toward the outer housing 44 into the lifting position 58 shown in FIGS. 10 and 11 and is let go of again, it returns automatically back into the starting position 56 again as a result of the action of the resetting spring 240. If, however, the actuating element 54 is moved into the lifting position 58 when feed water is running, or if the actuating element 54 is only released again after feed water has been switched on, the actuating element remains in contact with the lower valve seat 230, which is assigned to the first outflow section 202, counter to the force of the resetting spring 240 and as a result of the difference in pressure applied via the valve member 232. In this position, the first outflow passage 166 is therefore separated from the inflow passage 162 while the latter is connected in terms of flow to the control passage 200 via the second outflow section 202. If the actuating element 54 is in its first rotational position shown in FIG. 10, the control passage 200 is aligned with the second outflow passage 172, as a result of which the feed water enters exclusively into the first chamber 150, and therefore a spray jet in the form of a strainer jet is produced at the second water outlet 72.

Figure 9:
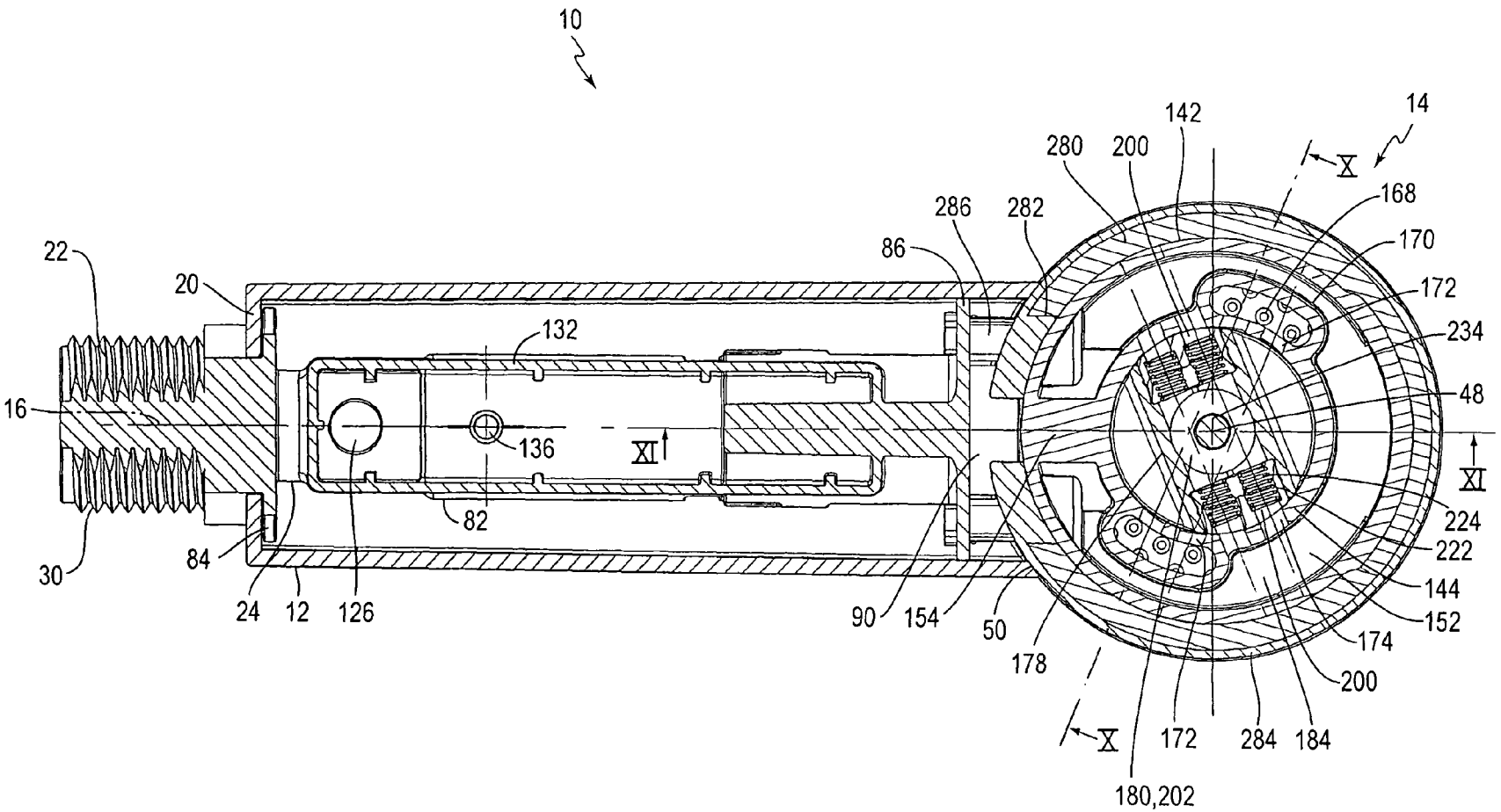
FIG. 9 shows the spray attachment in a longitudinal section along the line IX-IX of FIG. 3.

If, starting from this position, the actuating element 54 is brought 45° to the left, as seen in top view, into the rotational position shown in FIGS. 9 and 11, the control passage 200 is aligned with the third outflow passage 174, as a result of which the feed water enters exclusively into the second chamber 152 and emerges therefrom through the third water outlet 78, producing a spray jet in the form of a smooth and even jet.

Furthermore, by actuation of the pressure switch 42 covered by the membrane 40, the surroundings, in particular the object to be washed, can be illuminated.

Furthermore, flowing feed water causes the small turbine wheel 122 to rotate, which is detected by means of the sensor 126 and reported to the electronic control circuit 128. On the basis of this signal, the electronic control circuit 128 feeds the LEDs 290 of the light source 138 such that it can also be seen visually from the outside at the spray head 14 that feed water is flowing.

In the exemplary embodiments shown in the figures, the holding part 12 is equipped with a temperature sensor 136. The output signal thereof is supplied to the electronic control circuit 128 which activates the LEDs 290 of the light source 138 in a manner corresponding to the measured water temperature such that the LEDs change in color as a function of the water temperature, from, for example, blue for cold water into red for hot water. If the feed water inflow is switched off, the small turbine wheel 122 automatically ceases rotating, which is recognized by the electronic control circuit 128 via the sensor 126 such that the control circuit switches off the light source 138.

Figure 12:
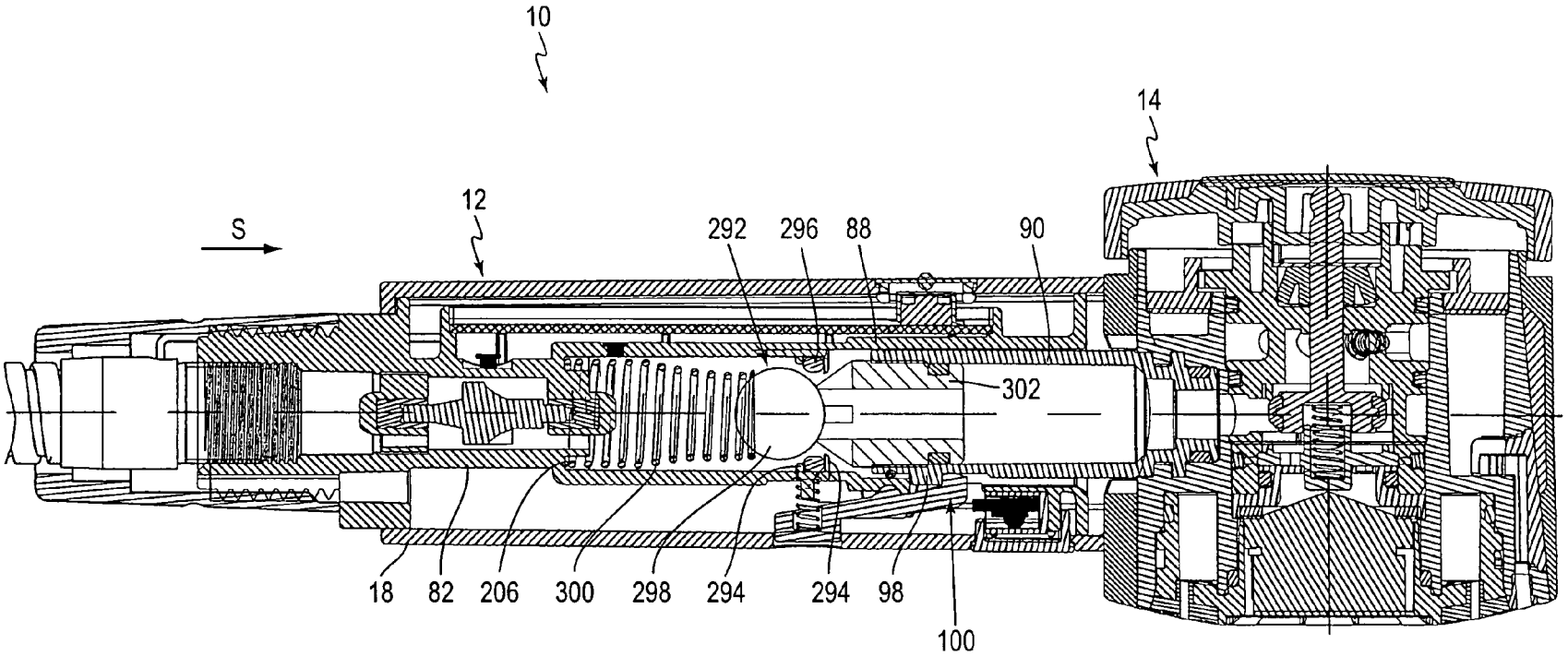
FIG. 12 shows, in an identical illustration to FIG. 3, a spray attachment according to an exemplary embodiment in which the holding part has a closing valve instead of a hollow piston.
Figure 13:
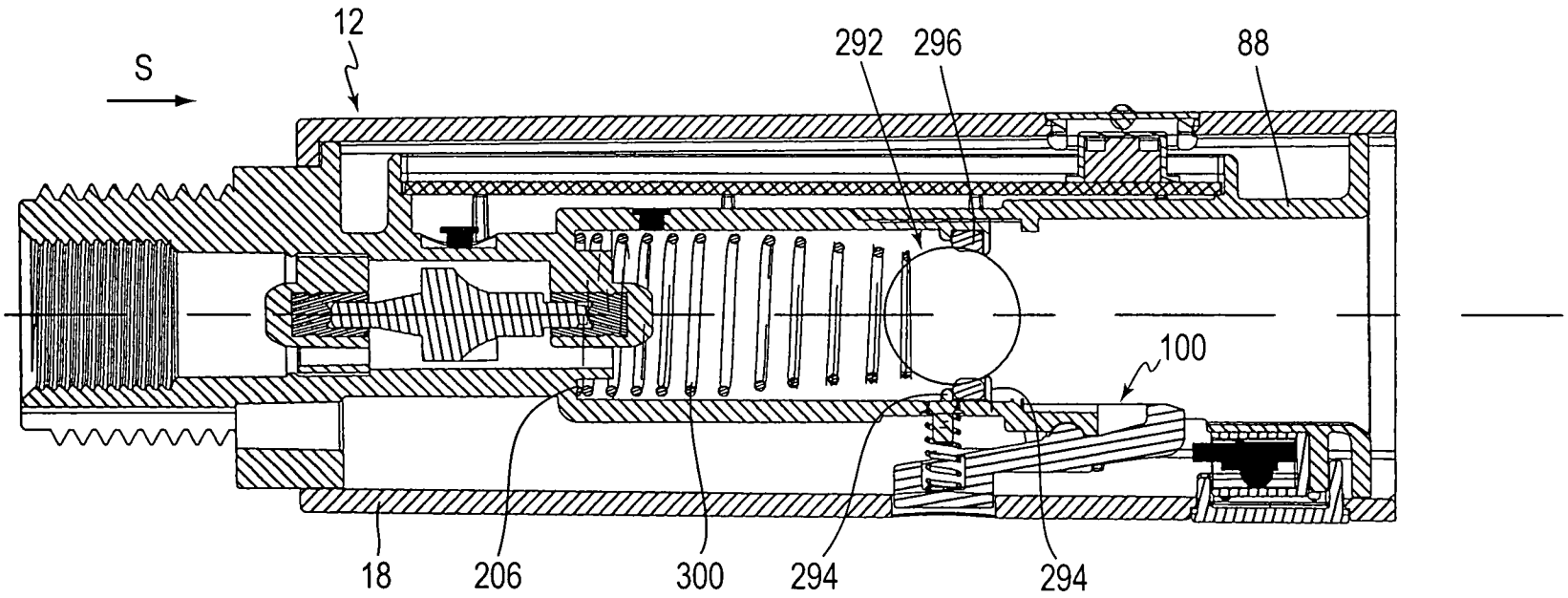
FIG. 13 shows, in an identical illustration to FIG. 4, the holding part of the spray attachment according to FIG. 12 with the closing valve closed.

The embodiment of the spray attachment according to the invention that is depicted in FIGS. 12 and 13 has a closing valve 292 instead of the hollow piston 102 in order to prevent feed water from flowing out of the holding part 12 when the spray head 14 is decoupled. Upstream of the joining region 88, encircling beads 294 which protrude inward in the radial direction are integrally formed on the water guiding part 82, the beads accommodating a sealing ring 296 between them. A ball 298 forming the valve closing member is arranged upstream of the sealing ring 296, the ball being acted upon by a closing force in the direction toward the sealing ring 296 by means of a valve spring 300 designed as a compression spring. At the other end, the valve spring 300 is supported, analogously to the piston spring 104, on the supporting shoulder 106.

A sleeve-shaped holding-open element 302 is threaded into the free end region of the connecting piece 90. The holding-open element protrudes over the connecting piece 90, counter to the flow direction S and, when the spray head 14 is coupled to the holding part 12, keeps the closing valve 292 in the open position. In the direction toward the ball 298, the end region of the holding-open element 302 is designed such that it tapers conically and is provided with radial slots which are open toward the ball 298 in order to keep a sufficient flow cross section free between them and the sealing ring 296 and ball 298. For the sake of completeness, it should be mentioned that an O-ring is arranged for providing a seal between the holding-open element 302 and the connecting piece 90, downstream of the thread of the holding-open element 302. Furthermore, a further sealing ring between the connecting piece 90 and the water guiding part 82 acts in the joining region 88, upstream of the latching cheek 98, in order to prevent water from emerging between the two parts into the interior of the holding part housing 18 or into the surroundings.

If, by release of the coupling 100, the spray head 14 is removed from the holding part 12 and should an error mean that the feed water is not switched off, the closing valve 292 closes (FIG. 13) and therefore prevents feed water from emerging to the surroundings. When the spray head 14 is attached to the holding part 12, the closing valve 292 is automatically opened (FIG. 12), preferably after the connecting piece 90 and the water guiding part 82 are in sealing engagement.

Of course, it is also possible to releasably connect a differently designed spray head 14 and a holding part 12 to each other via a coupling 100. The spray head could be a differently designed spray head of a kitchen spray or a spray head for a shower or a bath. In the exemplary embodiments shown, the holding part 12 forms a handle of a pull-out spray. However, it is also conceivable to form the holding part 12 as an outflow pipe, which is mounted, for example pivotably, on the base of a fitting and on which the spray head 14 is arranged in a manner such that it can be decoupled.

It is furthermore also possible to provide the spray head 14 with its switching options and/or its casing illumination in the case of a spray attachment in which the spray head 14 is not fastened by means of a coupling in a manner such that it can be removed from the holding part 12.

If the spray attachment is not equipped with illumination and sensors and is not equipped with an electronic control system, an electric feed line 36 is not required. In this case, the external thread 30 and the protective sleeve 32 can serve for the fastening of the feed water pipe 28.

What is claimed is:

1. A spray attachment, comprising:

a holding part which has a water guide connectable to a feed water pipe and a housing;

a spray head which has an external housing and a water outlet side, the water outlet side having a water outlet which is connected in terms of flow to the water guide, and a hollow piston having an end region which is angled with respect to the longitudinal direction of the holding part, the hollow piston being on the water outlet side and arranged in the water guide, wherein:

the spray head and the holding part are fastened separably to each other by means of a coupling, the spray head being separated and movable from the holding part without being restricted by the holding part when the holding part and the spray head are separated from each other, when the holding part and the spray head are coupled, the spray head pushes the hollow piston into the water guide counter to a force of a piston spring, and when the holding part and the spray head are separated from each other, the hollow piston protrudes with its water outlet from the housing of the holding part under the action of the piston spring.

2. The spray attachment of claim 1, wherein the coupling can be engaged and disengaged.

3. The spray attachment of claim 1, wherein—when the holding part and spray head are coupled—the holding part and a connecting piece of the spray head, which connecting piece protrudes in relation to the external housing, engage one inside the other.

4. The spray attachment of claim 3, wherein—when the holding part and spray head are coupled—the connecting piece is joined in the longitudinal direction to the water guide.

5. The spray attachment of claim 3, wherein the holding part has a latching lever actuated from the outside and a claw of which interacts with a latching cheek of the connecting piece when the holding part and spray head are coupled.

6. The spray attachment of claim 1, wherein a closing valve is arranged in the water guide and—when the holding part and spray head are coupled—is held in open position by the spray head and, when the spray head is decoupled, is in the closed position.

7. The spray attachment of claim 1, wherein the spray head has a fiber optic element, and the holding part has a light source, and when the holding part and spray head are coupled, light from the light source enters the fiber optic element.

8. The spray attachment of claim 7, wherein the holding part has an electronic control circuit which activates the light source.

9. The spray attachment of claim 7, wherein the light source is disposed at an end of the holding part on a side of the spray head.

10. The spray attachment of claim 1, wherein on a lower side of the holding part corresponding to the water outlet side, the holding part has a further light source for illuminating the surroundings.

11. The spray attachment of claim 10, wherein an upper side of the holding part, the holding part has a switch for switching the further light source on and off.

12. The spray attachment of claim 1, wherein the external housing has a casing wall, and—when the holding part and spray head are coupled—a front side of the holding part, which front side faces the spray head, is formed in an opposed manner to that section of the casing wall which bears thereagainst.

13. The spray attachment of claim 1, wherein the spray head has an actuating element which is rotatable and is movable in a translatory manner between a starting position and a lifting position, and a control element which is switchable by means of the actuating element, in order to connect the water guide to different water outlets for producing different spray jets.

14. A spray attachment, comprising:

a holding part which has a water guide connectable to a feed water pipe; and a spray head which has an external housing and a water outlet side, the water outlet side having a water outlet which is connected in terms of flow to the water guide, wherein the spray head and the holding part are fastened separably to each other by means of a coupling, the spray head has a fiber optic element, and the holding part has a light source, and when the holding part and spray head are coupled, light from the light source enters the fiber optic element, the holding part has an electronic control circuit which activates the light source, and the holding part has a flow sensor connected to the electronic control circuit.

15. The spray attachment of claim 14, wherein the holding part has a temperature sensor, which is connected to said electronic control circuit, in order to activate the light source as a function of the water flow.

16. The spray attachment of claim 15, wherein the temperature sensor activates the light source as a function of the water flow and the water temperature.

* * * * *